United States Patent [19]

Denis et al.

[11] Patent Number: 4,986,188

[45] Date of Patent: Jan. 22, 1991

[54] PROTECTIVE CASING FOR MUNITIONS HAVING MEANS ENABLING IT TO BE BROKEN THROUGH

[75] Inventors: Jean-Francois Denis, Checy; René Thouron, La Ferte Saint Aubin, both of France

[73] Assignee: Thomson-Brandt Armements, Boulogne Billancourt, France

[21] Appl. No.: 400,138

[22] Filed: Aug. 29, 1989

[30] Foreign Application Priority Data

Sep. 2, 1988 [FR] France ..... 88 11495

[51] Int. Cl.[5] ..... F42B 13/50

[52] U.S. Cl. ..... 102/493; 89/1.817; 102/377; 102/393; 102/495; 102/489

[58] Field of Search ..... 89/1.817; 102/495, 493, 102/496, 377, 389, 393

[56] References Cited

U.S. PATENT DOCUMENTS

| | | | |
|---|---|---|---|
| 2,872,865 | 2/1959 | Skaar | 102/473 |
| 3,140,638 | 7/1964 | De Luca | 89/1.817 |
| 3,164,091 | 1/1965 | Urdapilleta | 102/482 |
| 3,357,356 | 12/1967 | Bischoff | 102/378 |
| 3,498,224 | 3/1970 | Cordle et al. | 102/496 |
| 3,757,693 | 9/1973 | Shea | 102/493 |
| 3,757,694 | 9/1973 | Talley et al. | 102/495 |
| 4,004,518 | 1/1977 | Potteiger et al. | 102/495 |
| 4,301,708 | 11/1981 | Mussey | 89/1.817 |
| 4,305,333 | 12/1981 | Altenaii et al. | 102/493 |
| 4,455,943 | 6/1984 | Pinson | 102/489 |
| 4,498,368 | 2/1985 | Doane | 89/1.817 |
| 4,648,323 | 3/1987 | Lawther | 102/495 |

FOREIGN PATENT DOCUMENTS

| | | |
|---|---|---|
| 163029 | 4/1985 | European Pat. Off. . |
| 0186735 | 9/1986 | European Pat. Off. . |
| 2923877 | 12/1980 | Fed. Rep. of Germany . |
| 2402003 | 3/1979 | France . |
| 2438686 | 5/1980 | France . |
| 2325560 | 10/1982 | France . |
| 2551857 | 3/1985 | France . |

*Primary Examiner*—David H. Brown

*Attorney, Agent, or Firm*—Oblon, Spivak, McClelland, Maier & Neustadt

[57] ABSTRACT

Disclosed is a protective casing for ejectable munitions, having means enabling it to be broken through, this being a necessary operation for the sub-munitions to be ejected, in the next stage, without any difficulty of breaking through and ejection. The fracture lines are obtained by means of screens of high temperature resistant fibers arranged in a plane perpendicular to the internal and external surfaces of the casing. This casing is a part obtained, for example, by fusion and molding. The screen is integrated so that, during the casting of the metal, this metal links up all the fibers forming the screen together. The invention can be applied to protective casings, notably for rockets and munitions carriers.

7 Claims, 3 Drawing Sheets

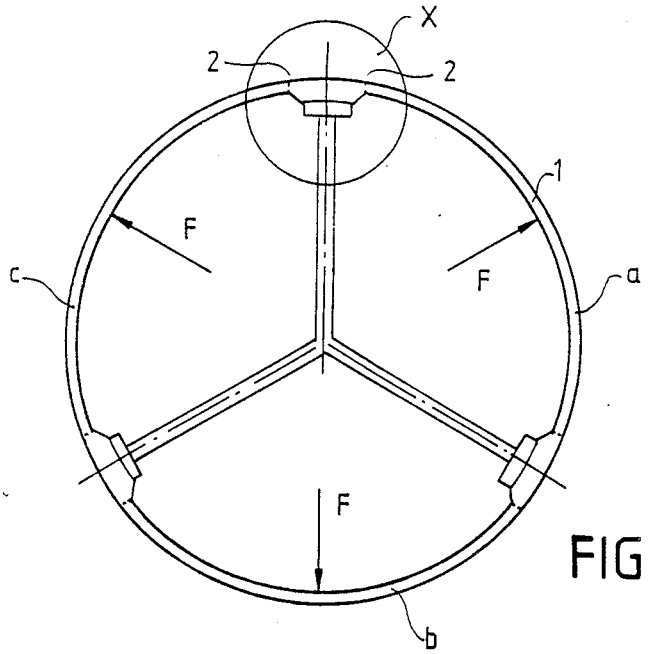
FIG. 4
FIG. 5
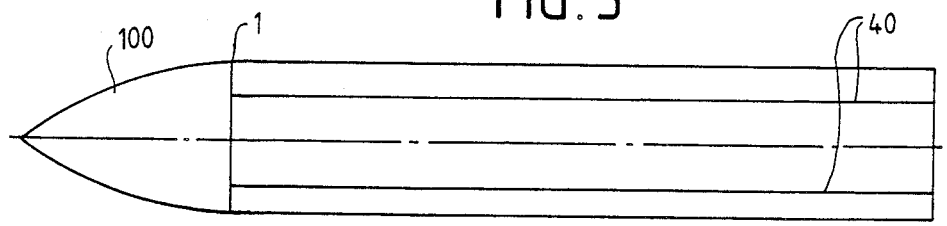
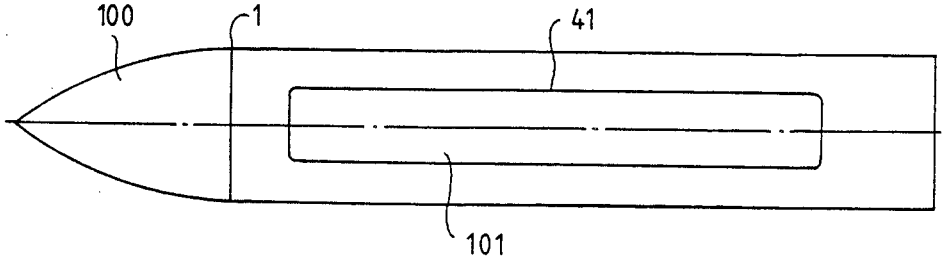
FIG. 6

PROTECTIVE CASING FOR MUNITIONS HAVING MEANS ENABLING IT TO BE BROKEN THROUGH

The invention concerns a protective casing for ejectable munitions, having means enabling it to be broken through: this is a necessary operation for the sub-munition or sub-munitions to be ejected without any difficulty of breaking through and ejection.

BACKGROUND OF THE INVENTION

Several approaches have been proposed to this end. In a first embodiment, if the casing or panel is one made of composite material, a weakening of the structure is designed and localized, for this purpose, at the level where the breaking through has to take place. This is obtained by pyrotechnical thrusters.

In another example, light alloy casings are used. These light alloy casings are made of two or three parts, connected to one another by mechanical connection means designed to yield under the effect of inflatable systems or pyrotechnical thrusters.

Another approach consists in providing detonating fuses on a casing made of light alloy or composite material: these fuses provide for the breaking through operation.

All these approaches are either expensive or unreliable. An aim of the present invention is, precisely, to overcome these drawbacks.

It concerns a new method that makes it more simple to fabricate casings or alveoli to protect munitions while, at the same time, enabling the simpler and more reliable application of standard breaking means such as the pyrotechnical thrusters to break the brittle zones.

SUMMARY OF THE INVENTION

The invention more precisely concerns a protective casing for munitions, said casing being made of metal, for example light alloy, shaped by fusion and molding, designed to be broken through at the level of a line capable of being fractured, hereinafter called a "fracture line", wherein, in the zone where this fracture line should be located, there is interposed a screen of temperature-resistant fibers, the plane of which is perpendicular to the internal and external surfaces of the casing such that, during the casting of the metal in the mold, the metal links the fibers together to form a strip of composite fiber-metal material with a width (e) forming a zone of embrittlement, the set formed by the casing and the said zone being obtained directly by means of fusion and molding operations.

BRIEF DESCRIPTION OF THE DRAWINGS

The invention will be better understood from the following explanations and the appended figures, of which:

FIG. 4 shows the application of the forces (F) needed for the breaking through of the casing;

FIGS. 5 to 9 illustrate several examples of fracture lines that can be obtained on a casing according to the invention.

DETAILED DESCRIPTION OF THE INVENTION

For greater clarity, the same elements bear the same references in all the figures.

The protective casing or alveolus according to the invention takes the form of a part obtained by fusion or molding with the addition of a screen of composite material, at the zone where the breaking through occurs. In accordance with the invention, the entire unit consisting of the casing and the fracturing zones comes directly from the fusion and molding operations.

Figure 1:
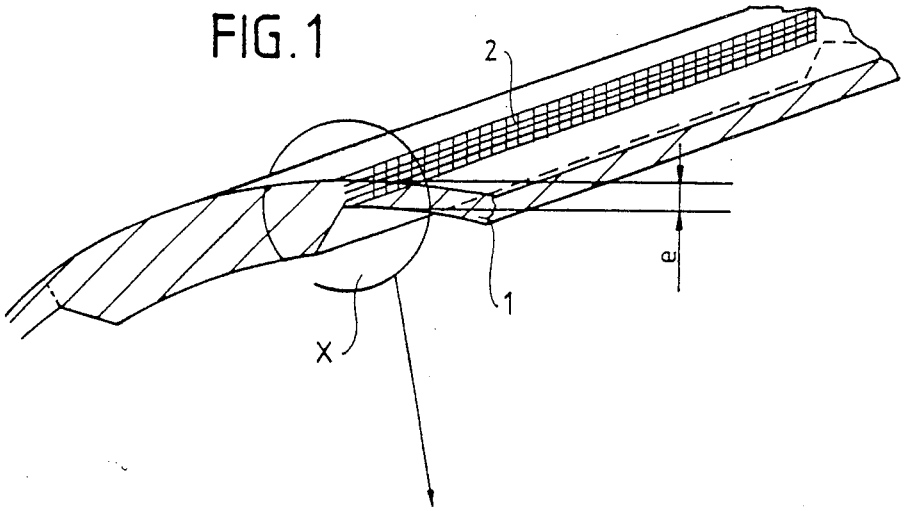
FIG. 1 gives a schematic view of a fitted out casing section, in accordance with the invention.

When a munition having to eject sub-munitions is designed, the fracture lines of the panels of the casing or of the alveoli are defined. The casing according to the invention is obtained by bringing a screen, formed by fibers, into play. During the casting of the molten metal, these fibers are crossed by the metal to form the composite (fiber-metal) material which forms the future fracture line. The structure obtained is illustrated by means of FIG. 1 which shows the cloth strip or screen 2 with a width (e), the plane of which is perpendicular to the internal and external surfaces of the molded casing (1).

Figure 2:
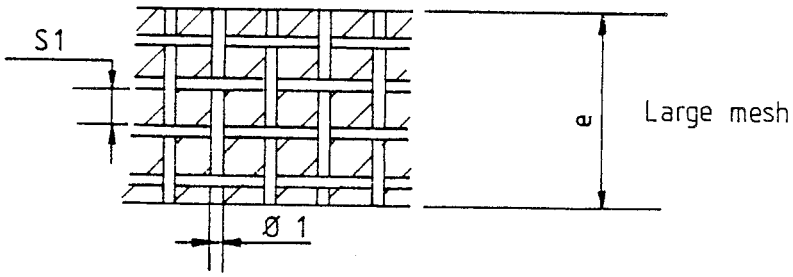
FIGS. 2 and 3 illustrate two variants of fiber screens incorporated in the casing during the casting operations, in accordance with the invention.
Figure 3:
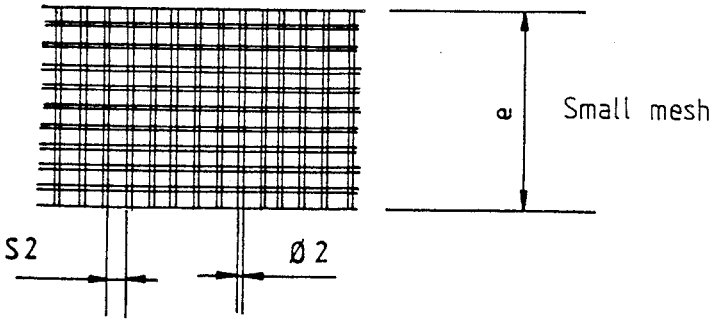

Under these conditions, it is possible to make a precise computation of the dimensions of these screens as a function of the desired brittleness. As the case may be, and as illustrated in FIGS. 2 and 3 respectively, they may be large-mesh screens or small-mesh screens. The spacing (s1, s2) between the fibers and their diameter ($\phi_1$, $\phi_2$) are parameters that can be easily controlled. Under these conditions, the assessment of the mechanical stresses of these zones, before and during the breaking through process, is also controlled and can be modified by adjusting these parameters, as required, in relation to the width (e) of the screen.

This results in many advantages. Firstly, a constant repetitivity of the breaking through operation is obtained, and this is a sign of reliability. Secondly, it is certain that a clean cut is obtained. Finally, the device is implemented at the lowest cost.

The breaking through operation itself can be done by and known means such as a pyrotechnical thruster. It is enough to quantify the necessary shock and adjust the thruster accordingly.

A casing (1) made of metal, for example of light alloy, shaped by fusion and molding, is fitted out with screens (2) defined earlier. A casing such as this is illustrated by means of FIG. 4. In this non-exhaustive example, the casing (1) has three parts (*a*), (*b*), (*c*) which have to be broken through and ejected. To do this, pyrotechnical means apply forces (F) to these three parts in a known way. The value of these forces (F) depends on the previously computed sizing of the screen (2) made of metal-fiber composite material. This screen (2) is more visible in FIG. 1 which is an enlargement of the zone (X) of the casing (1).

Figure 7A:
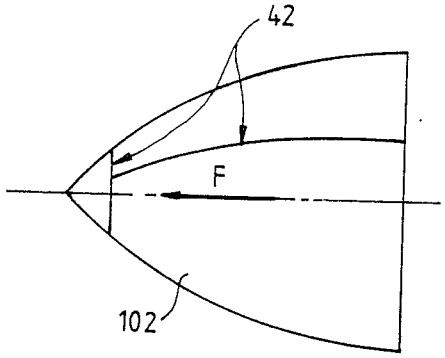
Figure 7B:
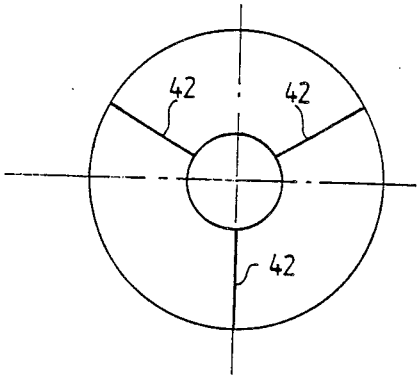

FIGS. 5 and 6 respectively illustrate the fracture lines (40) placed longitudinally along the casing (1) of a carrier (100), and (41) of a panel (101). FIG. 7, split up into a side view (7*a*) and sectional view (7*b*) illustrates the fracture line (42) of a nose (102).

Figure 8:
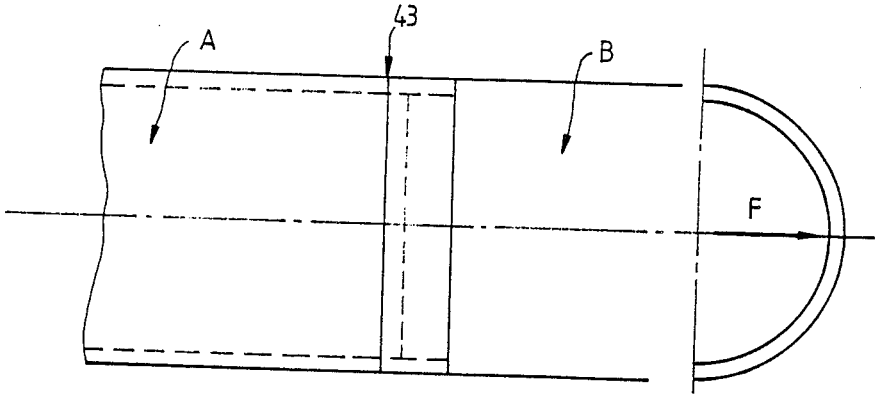

FIG. 8 shows the fracture line (43) between two sections (A) and (B) of the structure.

Figure 9A:
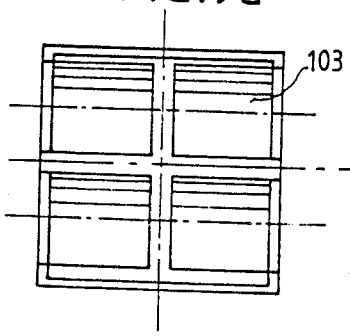
Figure 9B:
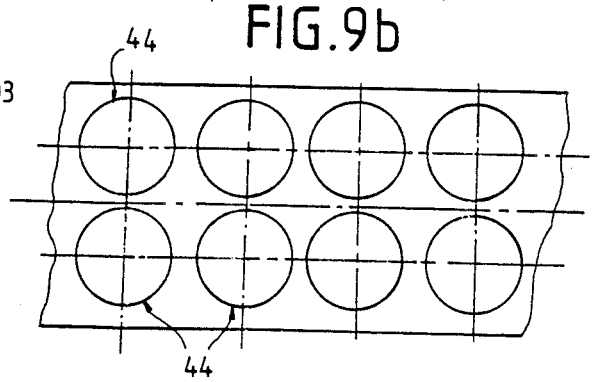

FIGS. 9*a* and 9*b* illustrate the fracture line (44) cut out in alveoli (103).

The invention can be applied to the making of rockets or sub-munitions carriers for which, at a given instant and in the chosen combat zone, it should be possible to break through and eject the protective casing. As stated above, the invention provides for total control over mechanical stresses, dependability of the breaking through operation and competitive fabrication costs.

What is claimed is:

1. A protective casing for munitions, said casing being made of metal, for example light alloy, shaped by fusion and molding, designed to be broken through at the level of a fracture line wherein, in the zone where this fracture line should be located, there is interposed a screen of temperature-resistant fibers, the plane of which is perpendicular to the internal and external surfaces of the casing such that, during the casting of the metal in the mold, the metal links the fibers together to form a strip of composite fiber-metal material with a width forming a zone of embrittlement, the set formed by the casing and the said zone being obtained directly by means of fusion and molding operations.

2. A casing according to claim 1, wherein the spacing between the fibers and the diameter of the threads, forming a mesh of varying size, as well as the width of the screen are computed as a function of the mechanical stresses that the casing should support before and during the breaking through operation.

3. A casing according to claim 1, wherein the fracture lines are arranged longitudinally along this casing.

4. A casing according to claim 1, wherein the fracture lines form a panel.

5. A casing according to claim 1, wherein the fracture line provides for the breaking through of a nose.

6. A casing according to claim 1, wherein the fracture line provides for the separation of the casing into two sections.

7. A casing according to claim 1, wherein the fracture line delimits the apertures of the alveoli.

* * * * *